US011826300B1

(12) United States Patent
Zhou

(10) Patent No.: US 11,826,300 B1
(45) Date of Patent: Nov. 28, 2023

(54) MASSAGING DEVICE

(71) Applicant: DONGGUAN AISI HEALTH CARE PRODUCT CO., LTD., Dongguan (CN)

(72) Inventor: Biao Zhou, Dongguan (CN)

(73) Assignee: DONGGUAN AISI HEALTH CARE PRODUCT CO., LTD., Dongguan (CN)

( * ) Notice: Subject to any disclaimer, the term of this patent is extended or adjusted under 35 U.S.C. 154(b) by 0 days.

(21) Appl. No.: 17/941,050

(22) Filed: Sep. 9, 2022

(30) Foreign Application Priority Data

Aug. 11, 2022 (CN) ..... 202222109320.3

(51) Int. Cl.
*A61H 19/00* (2006.01)

(52) U.S. Cl.
CPC ..... *A61H 19/44* (2013.01); *A61H 19/34* (2013.01); *A61H 2201/1215* (2013.01); *A61H 2201/1671* (2013.01); *A61H 2201/1676* (2013.01)

(58) Field of Classification Search
CPC ..... A61H 19/00–50; A61H 23/00–06; A61H 2023/002–045; A61H 2201/1676; A61H 2201/1671; A61H 2201/1215; A61H 21/00
USPC ..... 601/84
See application file for complete search history.

(56) References Cited

U.S. PATENT DOCUMENTS 6,190,307 B1 * 2/2001 Tsai ..... A61H 19/34 601/51
9,737,458 B1 * 8/2017 Olivares ..... A61H 21/00
2008/0091128 A1 * 4/2008 Nan ..... A61H 23/0263 601/46
2009/0198158 A1 * 8/2009 Nan ..... A61H 23/0254 601/87
2011/0144426 A1 * 6/2011 Blenk ..... A61H 23/02 600/38
2016/0120737 A1 * 5/2016 Sedic ..... A61H 19/44 601/46
2018/0042809 A1 * 2/2018 Zipper ..... A61H 19/44
2018/0140502 A1 * 5/2018 Shahoian ..... G16H 20/30
2018/0140504 A1 * 5/2018 Chang ..... A61H 99/00
2018/0161236 A1 * 6/2018 Bailey ..... A61H 19/44
2019/0290536 A1 * 9/2019 Greco ..... A61H 23/0254
2020/0163826 A1 * 5/2020 Topolev ..... A61H 23/0218
(Continued)

FOREIGN PATENT DOCUMENTS

CN 2239799 Y * 3/1995 ..... A61H 19/44
EP 666071 A1 * 8/1995 ..... A61H 7/005

OTHER PUBLICATIONS

Translation of CN-2239799-Y. Accessed on Nov. 17, 2022 from Espacenet. (Year: 1995).*
(Continued)

*Primary Examiner* — Valerie L Woodward
*Assistant Examiner* — Paige Kathleen Bugg

(57) ABSTRACT

The present disclosure provides a massaging device, which includes a first housing and a driving assembly received in the first housing, the driving assembly includes a tilting shaft and a rotating element connected with the tilting shaft, a length of the tilting shaft has a range of 10~50 mm, when the tilting shaft rotates, the tilting shaft is configured to drive the first housing to swing by the rotating element. The massaging device of the present disclosure has advantages of good massaging effect and long service life.

17 Claims, 11 Drawing Sheets

(56) References Cited

U.S. PATENT DOCUMENTS

| | | | | |
|---|---|---|---|---|
| 2021/0338523 | A1* | 11/2021 | Zheng | A61H 19/44 |
| 2021/0393475 | A1* | 12/2021 | He | A61H 19/44 |
| 2022/0071839 | A1* | 3/2022 | Huang | A61H 23/02 |
| 2022/0257457 | A1* | 8/2022 | Dickinson | A61H 19/40 |

OTHER PUBLICATIONS

Translation of EP 0666071 accessed from Espacenet on Mar. 7, 2023. (Year: 1995).*

* cited by examiner

MASSAGING DEVICE

FIELD

The present disclosure relates to a technical field of massaging equipment, specifically to a massaging device.

BACKGROUND

A massaging device typically provides its massaging effect through vibrations. In detail, one end of the massaging device can vibrate to massage. However, the movements of the existing massaging devices are fairly limited and are not designed to stimulate more than one area of the body simultaneously, so the existing massaging devices cannot satisfy users' needs. In addition, the existing massaging devices have a short service life due to their movement mechanisms.

SUMMARY

The present disclosure provides a massaging device, aiming at solving the problems of poor massage effect and short service life of the existing massaging device.

To achieve the above purpose, the present disclosure provides a massaging device which includes a first housing and a driving assembly received in the first housing, the driving assembly includes a tilting shaft and a rotating element connected with the tilting shaft, a length of the tilting shaft has a range of 1050 mm, when the tilting shaft rotates, the tilting shaft is configured to drive the first housing to swing by the rotating element.

In at least one embodiment, the driving assembly further includes a driving element, an output shaft of the driving element is connected at an angle with the tilting shaft.

In at least one embodiment, the angle between the tilting shaft and an axis of the output shaft of the driving element has a range of 0.5~25°.

In at least one embodiment, the output shaft of the driving element is integrated with the tilting shaft; and/or a length of the output shaft of the driving element has a range of 10~30 mm.

In at least one embodiment, the rotating element is flexible.

In at least one embodiment, the rotating element has a spherical structure or a polyhedral structure.

In at least one embodiment, the rotating element defines a receiving hole, and an end of the tilting shaft is received in the receiving hole.

In at least one embodiment, the first housing includes a first sub housing including a first guiding element, and a second sub housing connected with the first sub housing and including a second guiding element. The first guiding element defines a first via hole, the second guiding element defines a second via hole, the first guiding element is connected with the second guiding element to form a guiding cavity configured to receive the rotating element, the tilting shaft is connected with the rotating element after passing through the first via hole and the second via hole, when the tilting shaft rotates, the rotating element is abutted against an inner wall of the guiding cavity to drive the first sub housing and the second sub housing to swing.

In at least one embodiment, the first guiding element is protruded with an engaging portion, when the first guiding element is connected with the second guiding element, the second guiding element is engaged with the engaging portion.

In at least one embodiment, the first housing includes a first sub housing including a first connecting element, a second sub housing connected with the first sub housing and including a second connecting element, a third sub housing including a third connecting element, and a fourth sub housing connected with the third sub housing and including a fourth connecting element. The first connecting element is protruded with a first connecting column, the tilting shaft and the rotating element are received in the first sub housing and the second sub housing, the second connecting element is protruded with a second connecting column, the third connecting element defines a first connecting hole, the fourth connecting element defines a second connecting hole, the first connecting column is rotatably received in the first connecting hole, and the second connecting column is rotatably received in the second connecting hole.

In at least one embodiment, an inner wall of the first connecting hole is protruded with a plurality of first protrusions, each two adjacent first protrusions defines a first receiving groove, and the first receiving groove is configured to receive lubricant.

In at least one embodiment, an inner wall of the second connecting hole is protruded with a plurality of second protrusions, each two adjacent second protrusions defines a second receiving groove, and the second receiving groove is configured to receive lubricant.

In at least one embodiment, the massaging device further includes two protecting sleeves, respectively sleeved on the first connection column and the second connection column, and respectively at least partially received in the first connecting hole and the second connecting hole.

In at least one embodiment, the massaging device further includes two shock-absorbing elements, respectively sleeved on the first connecting column and the second connecting column, and respectively at least partially received in the first connecting hole and the second connecting hole.

In at least one embodiment, the third connecting element defines a first notch, the fourth connecting element defines a second notch, and the tilting shaft is connected with the rotating element after passing through the first notch and the second notch.

In at least one embodiment, the first housing further includes a fifth sub housing, a sixth sub housing connected with the fifth sub housing, and a flexible connecting member, configured to connect the fifth sub housing and the sixth sub housing with the third sub housing and the fourth sub housing.

In at least one embodiment, the flexible connecting member includes a first connecting portion connected with the third sub housing and the fourth sub housing, a second connecting portion, and a third connecting portion connected with the fifth sub housing and the sixth sub housing, the third connecting portion is connected with the first connecting portion by the second connecting portion, a size of the second connecting portion is smaller than a size of the first connecting portion and a size of the third connecting portion, so that the first connecting portion, the second connecting portion, and the third connecting portion cooperatively form an avoiding groove.

In at least one embodiment, the massaging device further includes a second housing, sleeved on the first housing, the second housing is made of a flexible material.

In at least one embodiment, the massaging device further includes a battery received in the first housing, and a circuit board received in the first housing, the battery and the circuit board are electrically connected with the driving assembly.

In at least one embodiment, the massaging device further includes a switch, electrically connected with the battery and the circuit board, and configured to control an operation of the driving assembly; and/or the massaging device further includes at least one vibrating motor, received in the first housing, and electrically connected with the battery and the circuit board.

In the technical solution of the present disclosure, the massaging device includes a first housing and a driving assembly received in the first housing. The driving assembly includes a tilting shaft and a rotating element connected with the tilting shaft, and the length of the tilting shaft has a range of 1050 mm. When the tilting shaft rotates, the tilting shaft drives the first housing to swing by the rotating element to massage more than one areas of the body. Moreover, the tilting shaft drives the first housing to swing by the rotating element, and the first housing can swing smoothly, so that the massage device can provide a better massage effect. In addition, the tilting shaft and the rotating element drive the first housing to swing back and forth consistently, thereby increasing the service life of the first housing, further increasing the service life of the massaging device.

BRIEF DESCRIPTION OF THE DRAWINGS

Implementations of the present disclosure will now be described, by way of embodiment, with reference to the attached figures. It should be understood, the drawings are shown for illustrative purpose only, for ordinary person skilled in the art, other drawings obtained from these drawings without paying creative labor by an ordinary person skilled in the art should be within scope of the present disclosure.

Figure 1:
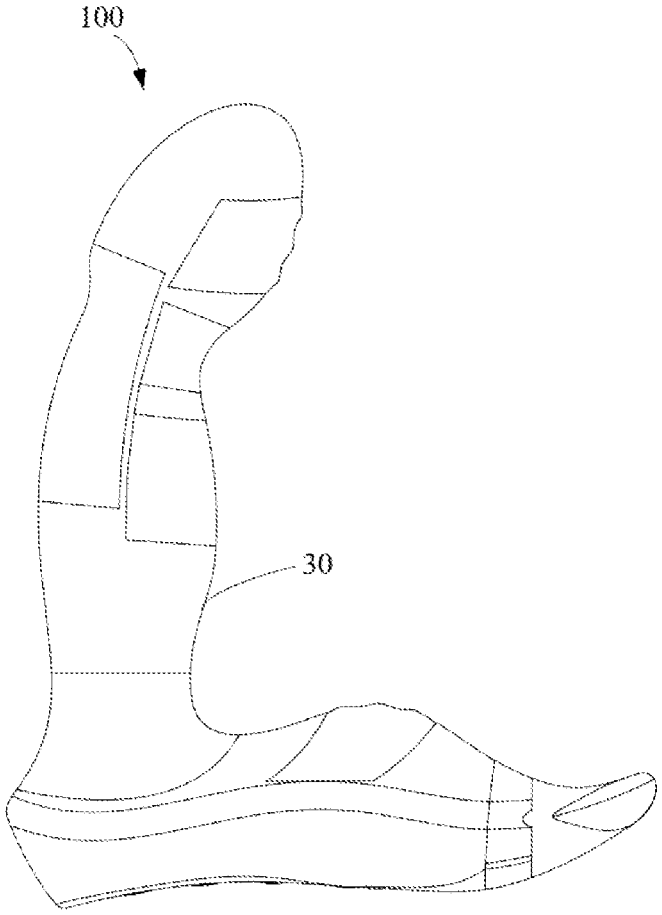
FIG. 1 is a structure diagram of a massaging device according to an embodiment of the present disclosure.

The realization of the aim, functional characteristics, advantages of the present disclosure are further described specifically with reference to the accompanying drawings and embodiments.

DETAILED DESCRIPTION

It will be appreciated that for simplicity and clarity of illustration, where appropriate, reference numerals have been repeated among the different figures to indicate corresponding or analogous elements. In addition, numerous specific details are set forth in order to provide a thorough understanding of the exemplary embodiments described herein. However, it will be understood by those of ordinary skill in the art that the exemplary embodiments described herein may be practiced without these specific details. In other instances, methods, procedures, and components have not been described in detail so as not to obscure the related relevant feature being described. Also, the description is not to be considered as limiting the scope of the exemplary embodiments described herein. The drawings are not necessarily to scale and the proportions of certain parts may be exaggerated to better illustrate details and features of the present disclosure.

The term "comprising" when utilized, means "including, but not necessarily limited to"; it specifically indicates open-ended inclusion in the so-described combination, group, series, and the like. the present disclosure is illustrated by way of example and not by way of limitation in the figures of the accompanying drawings in which like references indicate similar elements. It should be noted that references to "an" or "one" embodiment in this disclosure are not necessarily to the same embodiment, and such references can mean "at least one". In addition, the terms "first" and "second" are used for descriptive purposes only and cannot be understood as indicating or implying relative importance or implying the number of indicated technical features. Thus, the features defined as "first" and "second" may explicitly or implicitly include one or more of the said features. In the description of embodiments of the application, "a plurality of" means two or more, unless otherwise specifically defined.

Figure 2:
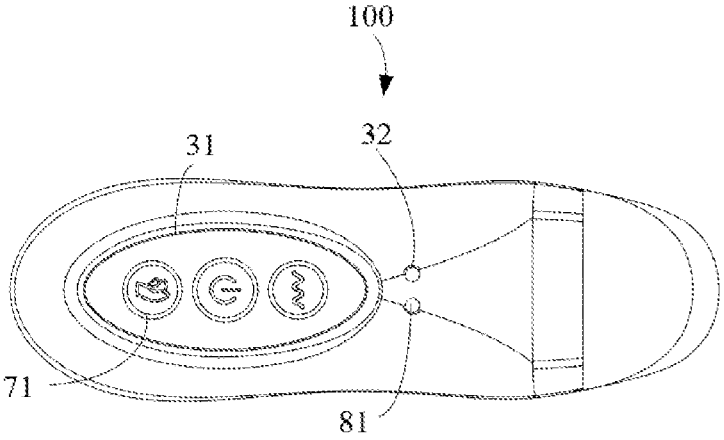
FIG. 2 is similar to FIG. 1, but shown from another view.
Figure 3:
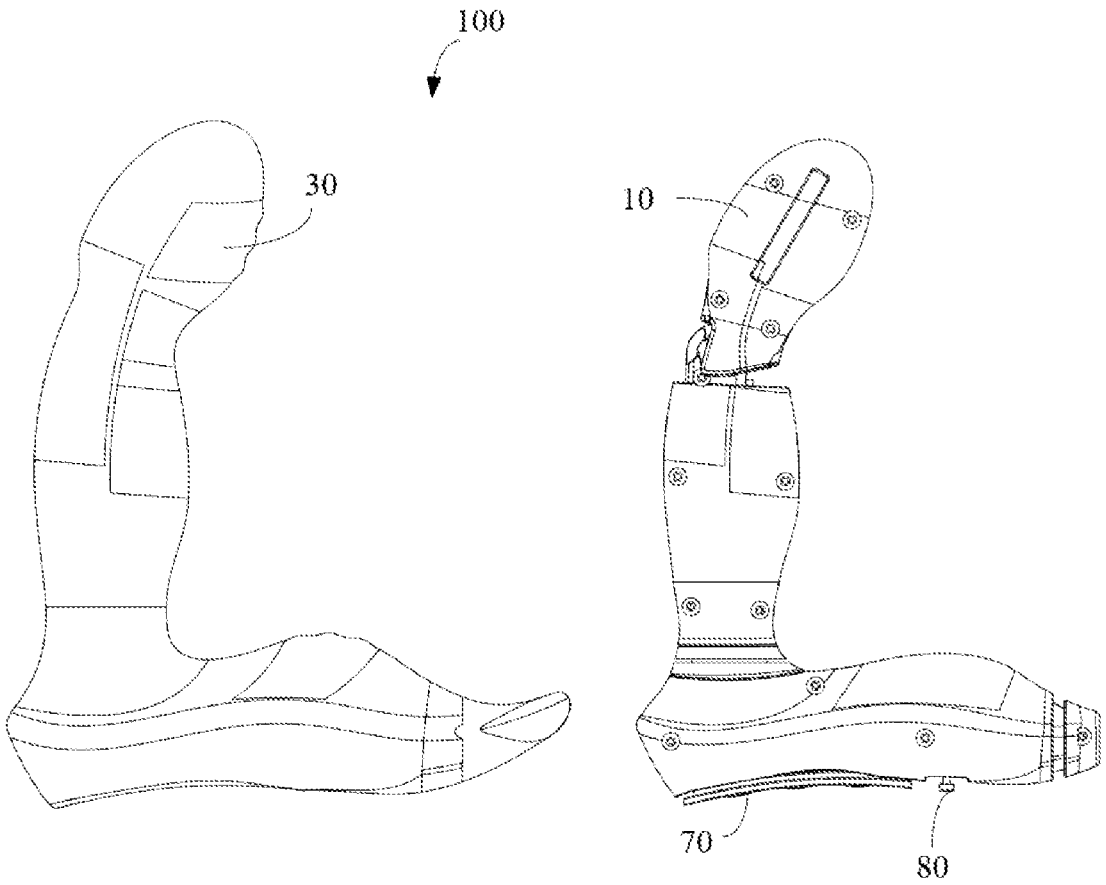
FIG. 3 is an exploded diagram of the massaging device of FIG. 1.
Figure 4:
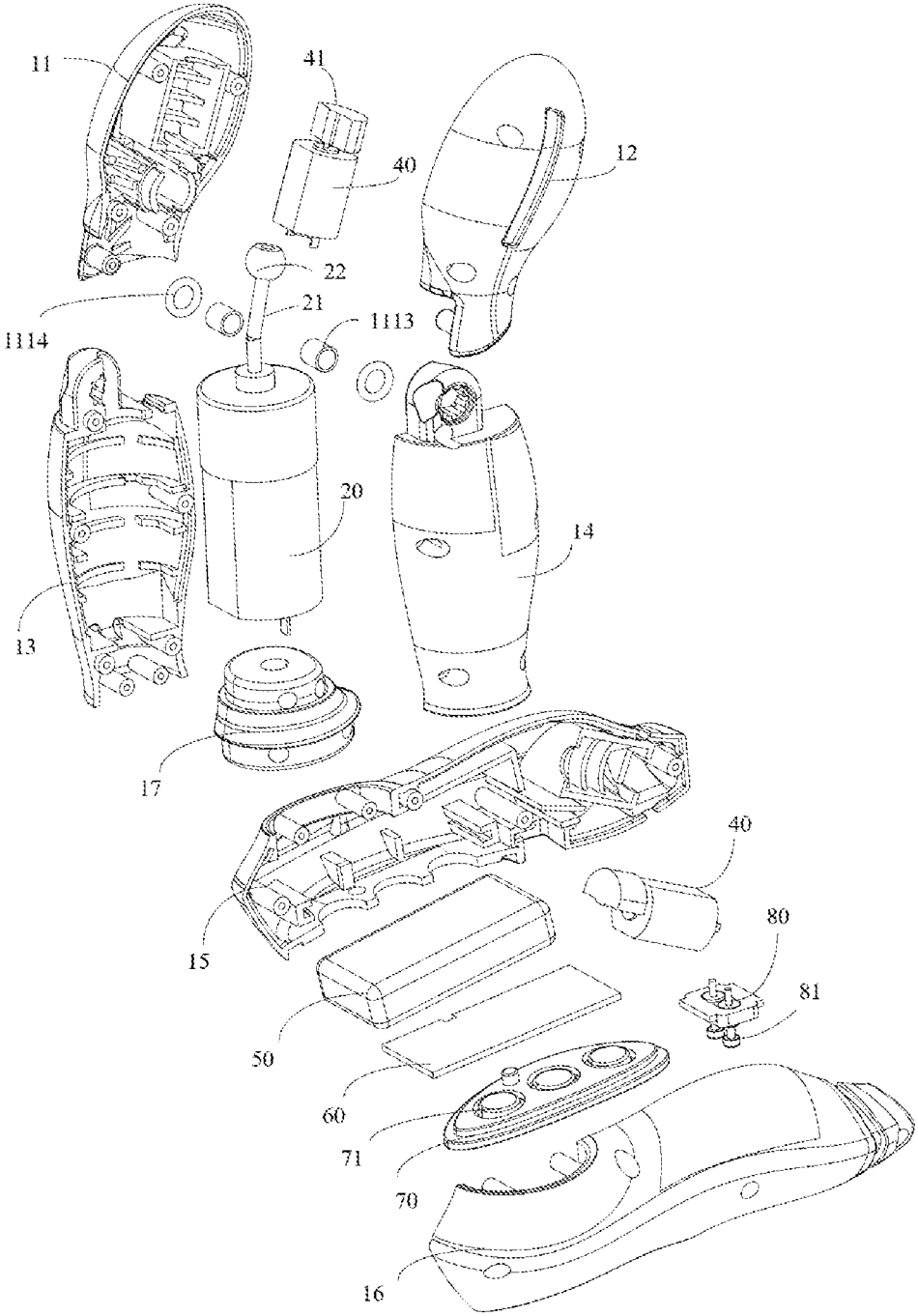
FIG. 4 is an exploded diagram of parts of the massaging device of FIG. 1.
Figure 5:
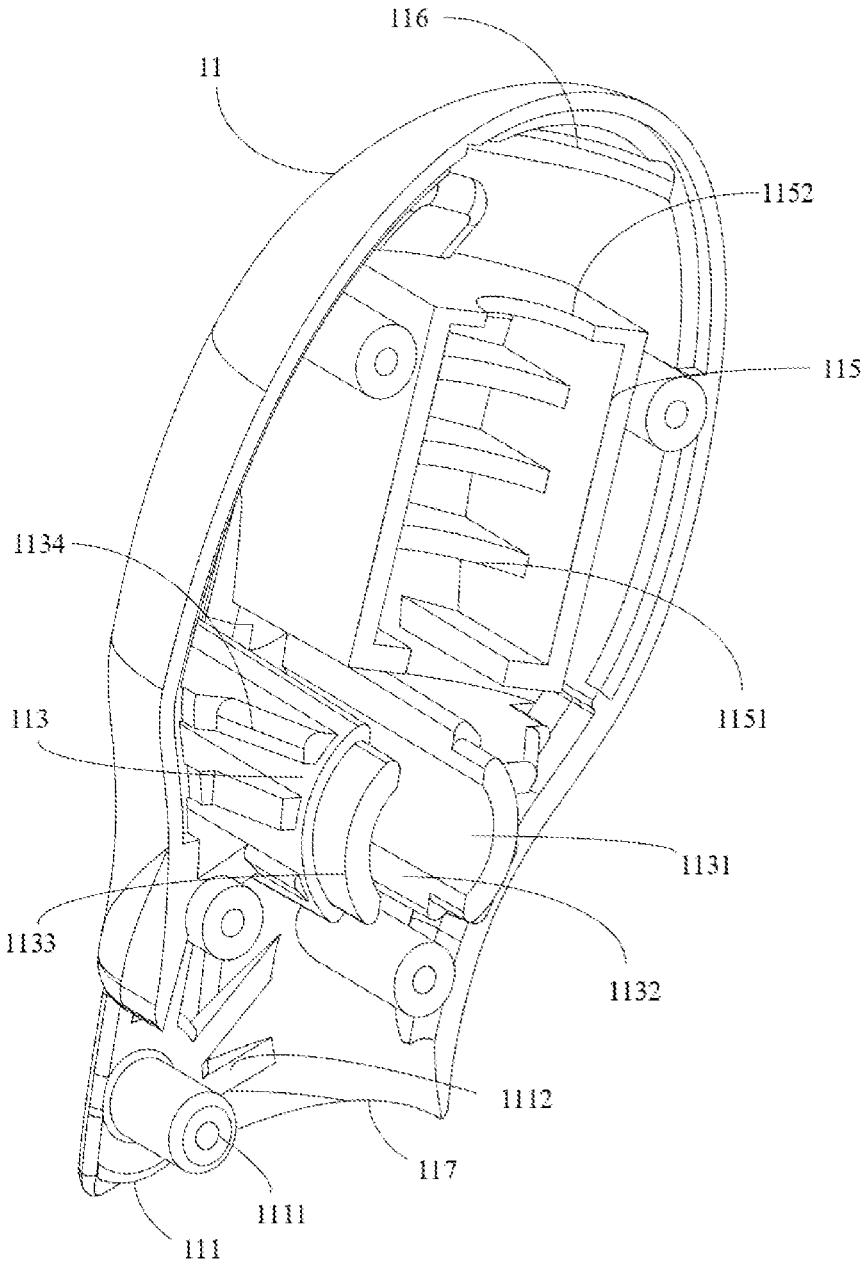
FIG. 5 is a structure diagram of a first sub housing of the massaging device of FIG. 4.
Figure 6:
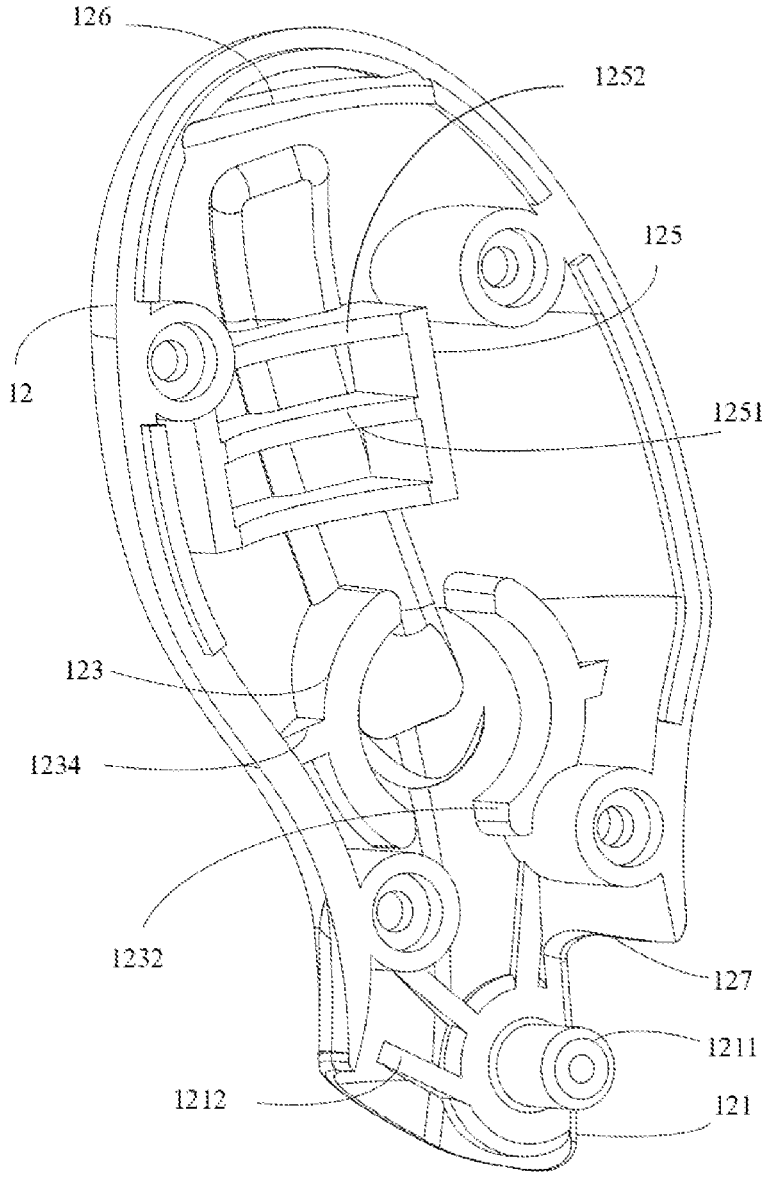
FIG. 6 is a structure diagram of a second sub housing of the massaging device of FIG. 4.
Figure 7:
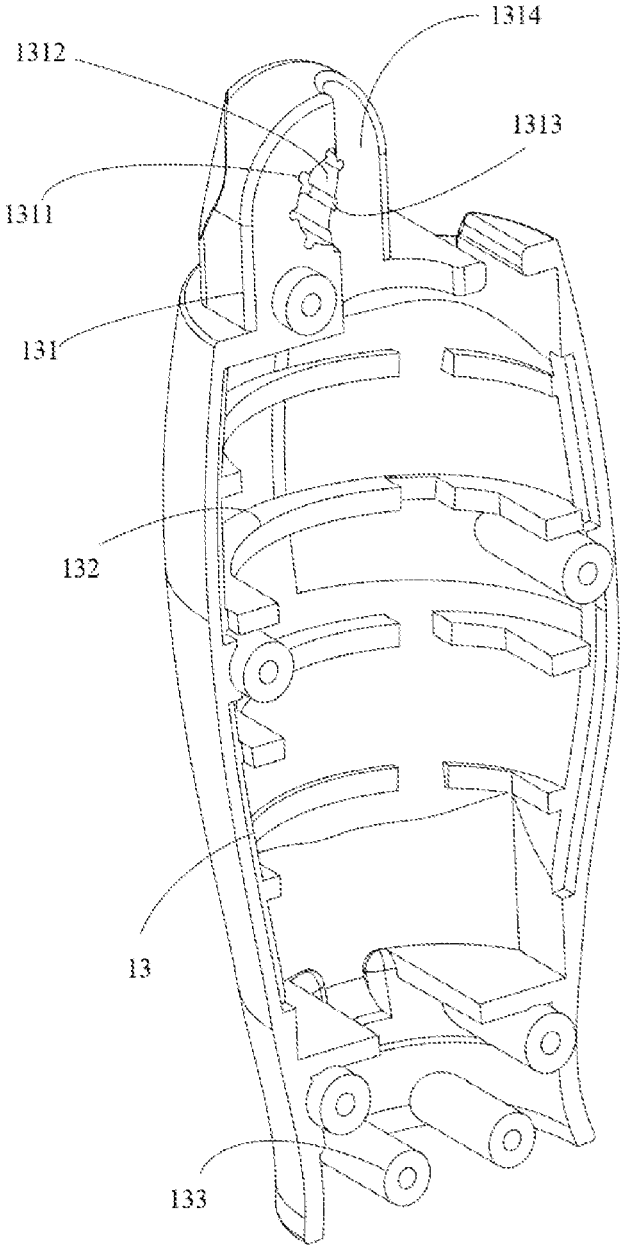
FIG. 7 is a structure diagram of a third sub housing of the massaging device of FIG. 4.
Figure 8:
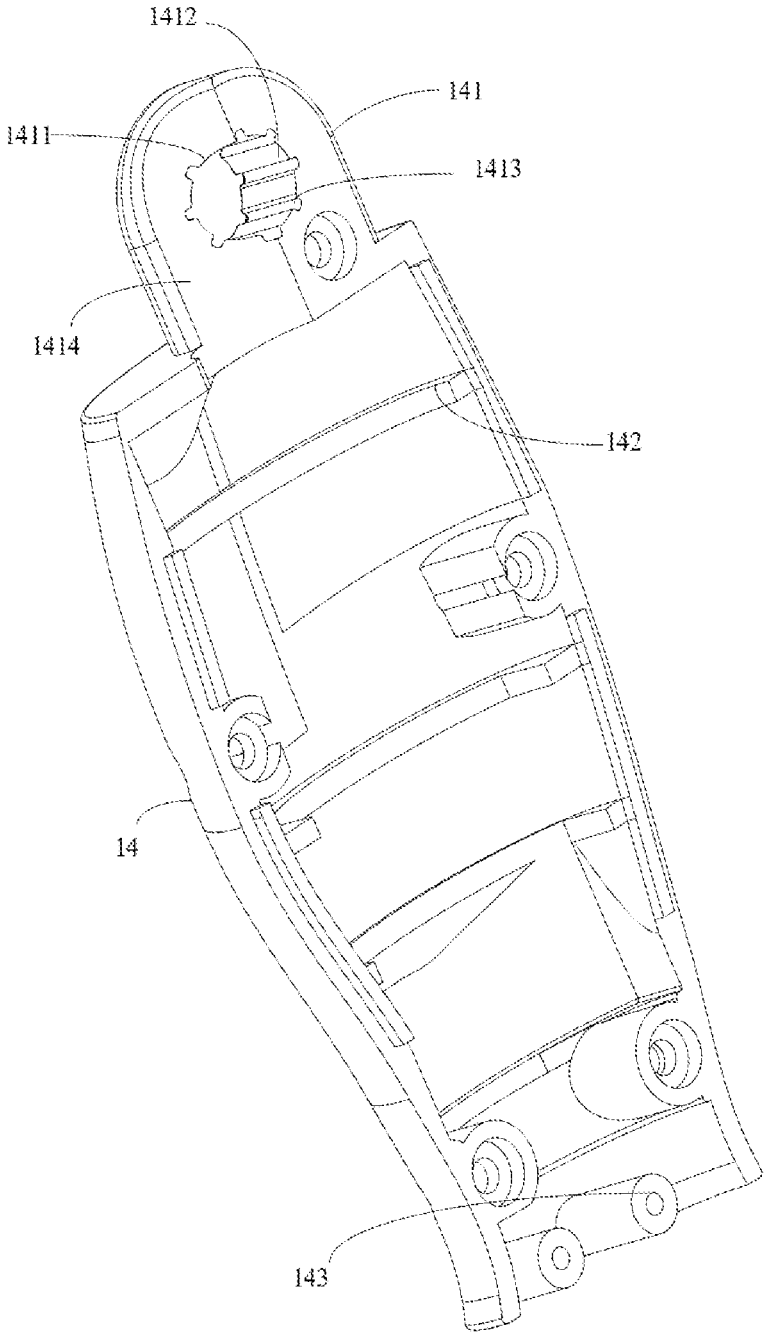
FIG. 8 is a structure diagram of a fourth sub housing of the massaging device of FIG. 4.
Figure 9:
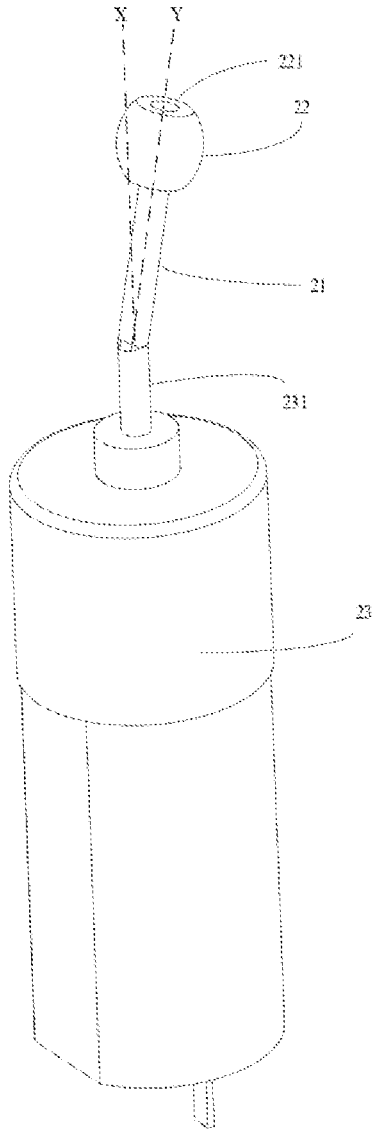
FIG. 9 is a structure diagram of a driving assembly of the massaging device of FIG. 4.
Figure 10:
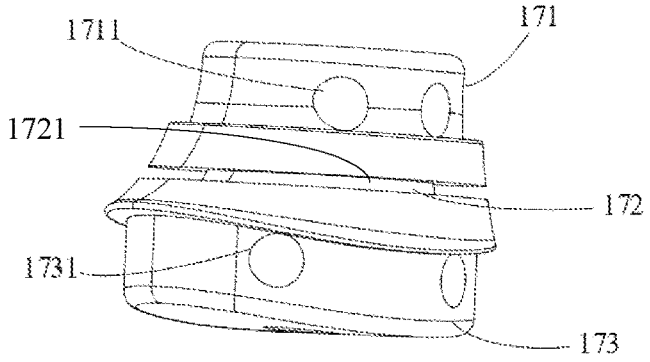
FIG. 10 is a structure diagram of a flexible connecting member of the massaging device of FIG. 4.
Figure 11:
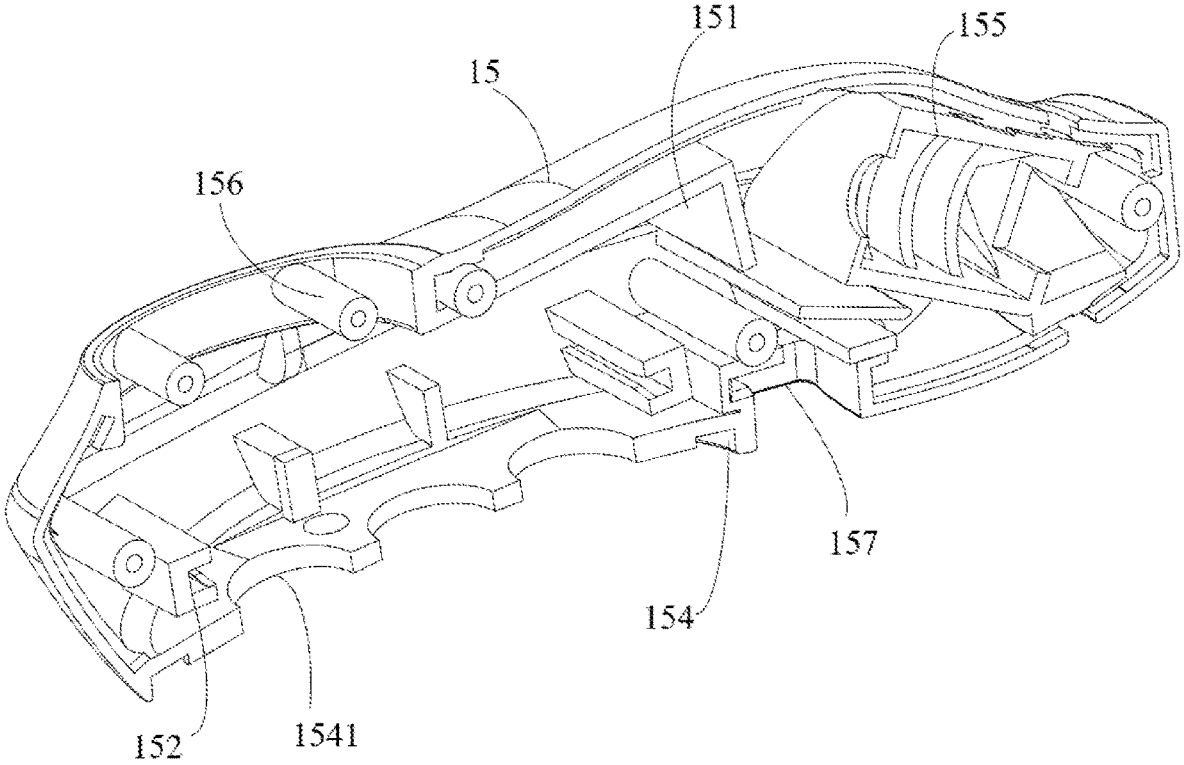
FIG. 11 is a structure diagram of a fifth sub housing of the massaging device of FIG. 4.
Figure 12:
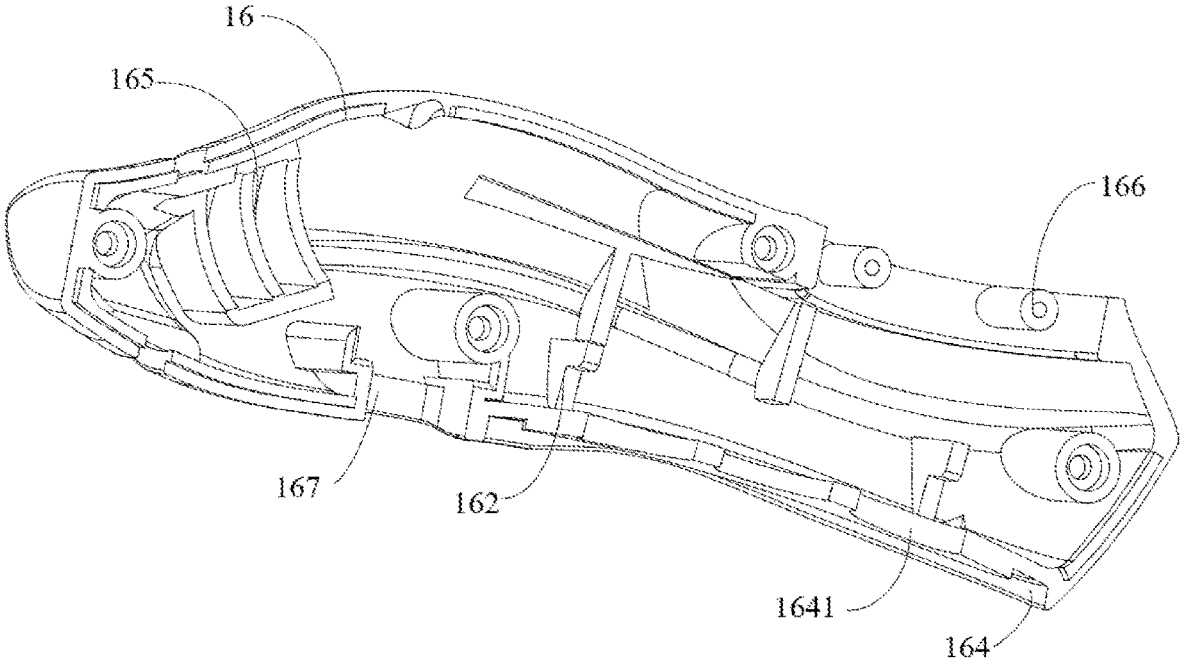
FIG. 12 is a structure diagram of a sixth sub housing of the massaging device of FIG. 4.

Please referring to FIGS. 1 to 12, the present disclosure provides a massaging device 100 according to an embodiment. The massaging device 100 includes a first housing 10 and a driving assembly 20 received in the first housing 10. The driving assembly 20 includes a tilting shaft 21 and a rotating element 22 connected with the tilting shaft 21, a length of the tilting shaft 21 has a range of 10~50 mm, when the tilting shaft 21 rotates, the tilting shaft 21 is configured to drive the first housing 10 to swing by the rotating element 22.

In at least one embodiment, the driving assembly 20 further includes a driving element 23, an output shaft 231 of the driving element 23 is connected at an angle with the tilting shaft 21. In detail, the driving element 23 includes a motor (not labeled) and a gear box (not labeled).

In at least one embodiment, the length of the tilting shaft 21 has the range of 1050 mm. For example, the length of the tilting shaft 21 is 10 mm, 15 mm, 20 mm, 25 mm, 35 mm, 40 mm, 45 mm, or 50 mm.

In at least one embodiment, the angle between the tilting shaft 21 and an axis Y of the output shaft 231 is 0.525°. In detail, the angle between the axis Y of the tilting shaft 21 and an axis X of the output shaft 231 is 0.525°. For example, the angle between the axis X and the axis Y is 0.5°, 1°, 5°, 10°, 15°, 20°, or 25°.

In at least one embodiment, a length of the output shaft 231 has a range of 1030 mm. For example, the length of the output shaft 231 is 10 mm, 15 mm, 20 mm, 25 mm, or 30 mm.

In at least one embodiment, the output shaft 231 is integrated with the tilting shaft 21.

In at least one embodiment, the rotating element 22 is flexible.

In at least one embodiment, the rotating element 22 has a spherical structure or a polyhedral structure. The polyhedral structure can be a regular polyhedron or an irregular polyhedron, such as a cube, a cuboid, an octahedron, an ellipsoid, a cone, a prism, or the like.

In at least one embodiment, the rotating element 22 defines a receiving hole 221, and an end of the tilting shaft 21 is received in the receiving hole 221. That is, the rotating element 22 is sleeved on the tilting shaft 21.

In at least one embodiment, the tilting shaft 21 is received in the receiving hole 221, and a free end of the tilting shaft 21 does not extend out of the receiving hole 221, so as to prevent the tilting shaft 21 from interfering with other components of the massaging device 100.

In at least one embodiment, the massaging device 100 further includes a second housing 30 sleeved on the first housing 10, and the second housing 30 is made of a flexible material, so as to provide a better touch sense. Specifically, the second housing 30 may be made of silicone or flexible plastic.

In at least one embodiment, the first housing 10 and the second housing 30 may be L-shaped. It should be understood that the shapes of the first housing 10 and the second housing 30 can be adjusted according to actual needs.

In the technical solution of the present disclosure, the massaging device 100 includes a first housing 10 and a driving assembly 20 received in the first housing 10. The driving assembly 20 includes a tilting shaft 21 and a rotating element 22 connected with the tilting shaft 21, and the length of the tilting shaft 21 has a range of 10~50 mm. When the tilting shaft 21 rotates, the tilting shaft 21 drives the first housing 10 to swing by the rotating element 22 to massage more than one areas of the body. Moreover, the tilting shaft 21 drives the first housing 10 to swing by the rotating element 22, and the first housing 10 can swing smoothly, so that the massage device 100 can provide a better massage effect. In addition, the tilting shaft 21 and the rotating element 22 drive the first housing 10 to swing back and forth consistently, thereby increasing the service life of the first housing 10, further increasing the service life of the massaging device 100.

The first housing 10 includes a first sub housing 11 and a second sub housing 12 connected with the first sub housing 11. The first sub housing 11 includes a first guiding element 113, and the first guiding element 113 defines a first via hole 1132. The second sub housing 12 includes a second guiding element 123, the second guiding element 123 defines a second via hole 1232. The first guiding element 113 is connected with the second guiding element 123 to form a guiding cavity 1131 configured to receive the rotating element 22, the tilting shaft 21 is passed through the first via hole 1132 and the second via hole 1232 and connected with the rotating element 22, when the tilting shaft 21 rotates, the rotating element 22 is abutted against an inner wall of the guiding cavity 1131 to drive the first sub housing 11 and the second sub housing 12 to swing.

In at least one embodiment, when the tilting shaft 21 rotates, the rotating element 22 is abutted against two opposite inner walls of the guiding cavity 1131 to drive the first sub housing 11 and the second sub housing 12 swing.

In at least one embodiment, the length of the tilting shaft 21 is defined as L, the angle between the axis X and the axis Y is defined as A, a swing distance of the first sub housing 11 and the second sub housing 12 is defined as D, D=2(tan A*L). The swing distance D refers to a swing distance of the first sub housing 11 and the second sub housing 12 when the tilting shaft 21 rotates 360 degrees. In a specific embodiment, when the tilting shaft 21 rotates 360 degrees, the first sub housing 11 and the second sub housing 12 swing in a first direction by a distance d1 and return to an initial position, then swing in a second direction opposite to the first direction by a distance d2 and return to the initial position, and D=2*(d1+d2).

It should be understood that the swinging distance D changes with the length L and the angle A.

In at least one embodiment, the first sub housing 11 and the second sub housing 12 can be connected by clipping, bonding, or welding, etc.

In at least one embodiment, the first guiding element 113 is protruded with an engaging portion 1133, when the first guiding element 113 is connected with the second guiding element 123, the second guiding element 123 is engaged with the engaging portion 1133.

In at least one embodiment, the engaging portion 1133 is protruded from an end wall of the first guiding element 113, and the engaging portion 1133 and the end wall of the first guiding element 113 cooperatively form a step (not labeled). When the first guiding element 113 is connected with the second guiding element 123, the second guiding element 123 is arranged on the step and engaged with the engaging portion 1133.

In at least one embodiment, the first guiding element 113 defines two opposite first via holes 1132.

In at least one embodiment, the second guiding element 123 defines two opposite second via holes 1232.

In at least one embodiment, an outer wall of the first guiding element 113 is further provided with at least one first reinforcing rib 1134. The first reinforcing rib 1134 is connected between the outer wall of the first guiding element 113 and an inner wall of the first sub housing 11.

In at least one embodiment, an outer wall of the second guiding element 123 is further provided with at least one second reinforcing rib 1234. The second reinforcing rib 1234 is connected between the outer wall of the second guiding element 123 and an inner wall of the second sub housing 12.

In at least one embodiment, the massaging device 100 further includes at least one vibrating motor 40. The first sub housing 11 includes a first mounting portion 115, the second sub housing 12 includes a second mounting portion 125, and the vibrating motor 40 is mounted in the first mounting portion 115 and the second mounting portion 125.

In at least one embodiment, at least one supporting plate 1151 is protruded from an inner surface of the first mounting portion 115, at least one second supporting plate 1251 is protruded from an inner surface of the second mounting portion 125, when the vibrating motor 40 is installed in the first mounting portion 115 and the second mounting portion 125, the first supporting plate 1151 and the second supporting plate 1251 are configured to support the vibrating motor 40.

In at least one embodiment, the inner wall of the first sub housing 11 is further recessed with a first mounting groove 116, and the inner wall of the second sub housing 12 is further recessed with a second mounting groove 126. The first mounting portion 115 defines a first opening 1152, and the second mounting portion 125 defines a second opening 1252. The vibrating motor 40 further includes an eccentric block 41, and an output shaft (not labeled) of the vibrating motor 40 is extended out of the first opening 1152 and the second opening 1252, and the eccentric block 41 can be accommodated in the first mounting groove 116 and the second mounting groove 126.

In at least one embodiment, the first mounting groove 116 is defined at a free end of the first sub housing 11, and the second mounting groove 126 is defined at a free end of the second sub housing 12.

In the technical solution of the present disclosure, the first sub housing 11 of the first housing 10 includes a first guide element 113, and the first guide element 113 defines a first via hole 1132. The second sub housing 12 of the first housing 10 includes a second guide element 123, and the second guide element 123 defines a second via hole 1232. The first guide element 113 is connected with the second guide element 123 to form a guiding cavity 1131 configured for receiving the rotating element 22, and the tilting shaft 21 is passed through the first via hole 1132 and the second via hole 1232 and then connected with the rotating element 22. When the tilting shaft 21 rotates, the rotating element 22 is abutted against the inner wall of the guiding cavity 1131 to drive the first sub housing 11 and the second sub housing 12 to swing. The tilting shaft 21 drives the first sub housing 11 and the second sub housing 12 to swing by the rotating element 22, so that the first sub housing 11 and the second sub housing 12 can vibrate smoothly and strongly, so that the massage device 100 can provide a better massage effect. Moreover, the tilting shaft 21 and the rotating element 22 can drive the first sub housing 11 and the second sub housing 12 to swing back and forth consistently, so that the service lives of the first sub housing 11 and the second sub housing 12 are increased, and the service life of the massage device 100 is also increased.

The first sub housing 11 further includes a first connecting element 111, and the first connecting element 111 is protruded with a first connecting column 1111. The second sub housing 12 further includes a second connecting element 121, and the second connecting element 121 is protruded with a second connecting column 1211. The first housing 10 further includes a third sub housing 13 and a fourth sub housing 14, and the fourth sub housing 14 is connected with the third sub housing 13. The third sub housing 13 includes a third connecting element 131, and the third connecting element 131 defines a first connecting hole 1311. The fourth sub housing 14 includes a fourth connecting element 141, the fourth connecting element 141 defines a second connecting hole 1411, the first connecting column 1111 is rotatably received in the first connecting hole 1311, and the second connecting column 1211 is rotatably received in the second connecting hole 1411.

In at least one embodiment, when the tilting shaft 21 rotates, the rotating element 22 is abutted against two opposite inner walls of the guiding cavity 1131 to drive the first sub housing 11 and the second sub housing 12 to swing in directions of moving towards the third sub housing 13 and moving away from the third sub housing 13.

In at least one embodiment, the first sub housing 11 further includes a first avoiding area 117, the second sub housing 12 further includes a second avoiding area 127, and the second avoiding area 127 is communicated with the first avoiding area 117. The first avoiding area 117 and the second avoiding area 127 can provide a space for the first sub housing 11 and the second sub housing 12 to swing, thereby preventing the first sub housing 11 and the second sub housing 12 from colliding with the third sub housing 13 and the fourth sub housing 14 when swinging.

In at least one embodiment, an outer wall of the first connecting element 111 is further provided with at least one third reinforcing rib 1112. The third reinforcing rib 1112 is connected between the outer wall of the first connecting element 111 and the inner wall of the first sub housing 11.

In at least one embodiment, an outer wall of the second connecting element 121 is further provided with at least one fourth reinforcing rib 1212. The third reinforcing rib 1212 is connected between the outer wall of the first connecting element 111 and the inner wall of the first sub housing 11.

In at least one embodiment, an inner wall of the first connecting hole 1311 is protruded with a plurality of first protrusions 1312, and a first receiving groove 1313 is formed between each two adjacent first protrusions 1312. The first receiving groove 1313 is configured for accommodating lubricant, so as to ensure that the first sub housing 11 can rotate smoothly.

In at least one embodiment, an inner wall of the second connecting hole 1411 is protruded with a plurality of second protrusions 1412, and a second receiving groove 1413 is formed between each two adjacent second protrusions 1412. The second receiving groove 1413 is configured for accommodating lubricant, so as to ensure that the second sub housing 12 can rotate smoothly.

In at least one embodiment, the massage device 100 further includes two protecting sleeves 1113 and two shock-absorbing elements 1114, the two protecting sleeves 1113 are respectively sleeved on the first connecting column 1111 and the second connecting column 1211, and are respectively at least partially received in the first connecting hole 1311 and the second connecting hole 1411. The lubricant can be filled between a groove wall of the first receiving groove 1313 and an outer wall of the protecting sleeve 1113, and can also be filled between a groove wall of the second receiving groove 1413 and the outer wall of the protecting sleeve 1113. The two shock-absorbing elements 1114 are respectively sleeved on the first connecting column 1111 and the second connecting column 1211, and are respectively at least partially received in the first connecting hole 1311 and the second connecting hole 1411. Specifically, the two shock-absorbing elements 1114 may be respectively arranged between the first connecting column 1111 and the inner wall of the first sub housing 11, and the second connecting column 1211 and the inner wall of the second sub housing 12, thereby reducing the vibration at a connecting of the first sub housing 11 and the third sub housing 13, and reducing the vibration at a connection of the second sub housing 12 and the fourth sub housing 14.

In at least one embodiment, the protecting sleeve 1113 has a hollow cylindrical structure.

In at least one embodiment, the shock-absorbing element 1114 has an annular structure.

In at least one embodiment, the third connecting element 131 defines a first notch 1314, the fourth connecting element 141 defines a second notch 1414, and the tilting shaft 21 is passed through the first notch 1314 and the second notch 1414, and then connected with the rotating element 22.

In at least one embodiment, an inner wall of the third sub housing 13 is further protruded with at least one first mounting block 132, and an inner wall of the fourth sub housing 14 is further protruded with at least one second mounting block 142. When the third sub housing 13 is connected with the fourth sub housing 14, the driving element 23 can be mounted on the first mounting block 132 and the second mounting block 142.

In the technical solution of the present disclosure, the first connecting element 111 of the first sub housing 11 is protruded with a first connecting column 1111, and the second connecting element 121 of the second sub housing 12 is protruding with a second connecting column 1211. The third connecting element 131 of the third sub housing 13 defines a first connecting hole 1311. The fourth connecting element 141 of the fourth sub housing 14 defines a second connecting hole 1411, the first connecting column 1111 is rotatably received in the first connecting hole 1311, and the second connecting column 1211 is rotatably received in the second connecting hole 1411. In this way, the first sub housing 11 is rotatably connected with the third sub housing 13, and the second sub housing 12 is rotatably connected with the fourth sub housing 14.

The first housing 10 further includes a fifth sub housing 15, a sixth sub housing 16, and a flexible connecting member 17. The sixth sub housing 16 is connected with the fifth sub housing 15. The flexible connecting member 17 is configured to connect the fifth sub housing 15 and the sixth sub housing 16 with the third sub housing 13 and the fourth sub housing 14.

In at least one embodiment, the fifth sub housing 15 is connected at an angle with the third sub housing 13 and the fourth sub housing 14.

In at least one embodiment, the sixth sub housing 16 is connected at an angle with the third sub housing 13 and the fourth sub housing 14.

In at least one embodiment, the flexible connecting member 17 includes a first connecting portion 171 connected with the third sub housing 13 and the fourth sub housing 14, a second connecting portion 172, and a third connecting portion 173 connected with the fifth sub housing 15 and the sixth sub housing 16, and the second connecting portion 172 is connected between the first connecting portion 171 and the third connecting portion 173.

In at least one embodiment, the first connecting portion 171 defines a plurality of mounting holes 1711, the third sub housing 13 is protruded with at least one mounting post 133, and the fourth sub housing 14 is protruded with at least one mounting post 143, the mounting post 133 and the mounting post 143 are mounted in the mounting holes 1711, so as to connect the flexible connecting member 17 with the third sub housing 13 and the fourth sub housing 14.

In at least one embodiment, the third connecting portion 173 defines a plurality of mounting holes 1731, the fifth sub housing 15 is protruded with at least one mounting post 156, and the sixth sub housing 16 is protruded with at least one mounting post 166, the mounting post 156 and the mounting post 166 are mounted in the mounting holes 1731 to connect the flexible connecting member 17 with the fifth sub housing 15 and the sixth sub housing 16.

In at least one embodiment, a size of the second connecting portion 172 is smaller than a size of the first connecting portion 171 and a size of the third connecting portion 173, so that the first connecting portion 171 and the third connecting portion 173 can smoothly swing or vibrate relative to the second connecting portion 172. As the size of the second connecting portion 172 is smaller than the size of the first connecting portion 171 and the size of the third connecting portion 173, the first connecting portion 171, the second connecting portion 172, and the third connecting portion 173 cooperatively form an avoiding groove 1721, the avoiding groove 1721 can provide a space for a deformation or a rotation of the first connecting portion 171 and the third connecting portion 173, so as to adjust an angle between the third sub housing 13 and the fifth sub-housing 15 and/or an angle between the fourth sub housing 14 and the sixth sub-housing 16.

In the technical solution of the present disclosure, the first housing 10 further includes a fifth sub housing 15, a sixth sub housing 16, and a flexible connecting member 17. The flexible connecting member 17 includes a first connecting portion 171 connected with the third sub housing 13 and the fourth sub housing 14, a second connecting portion 172, and a third connecting portion 173 connected with the fifth sub housing 15 and the sixth sub housing 16. The second connecting portion 172 is connected between the first connecting portion 171 and the third connecting portion 173. Since the first connecting portion 171, the second connecting portion 172 and the third connecting portion 173 are flexible, the first housing 10 can vibrate and/or swing more smoothly, thereby improving the massaging effect of the massaging device 100.

The massage device 100 further includes a battery 50, a circuit board 60, a switch 70, and a charging element 80. The driving assembly 20, the switch 70, and the charging element 80 are all electrically connected with the battery 50 and the circuit board 60. The switch 70 is configured to turn on or turn off the driving assembly 20 and the vibrating motor 40, and is also configured to adjust vibration modes or vibration strengths of the driving assembly 20 and the vibrating motor 40.

In at least one embodiment, the fifth sub housing 15 is internally provided with a third mounting portion 151, and the battery 50 is mounted on the third mounting portion 151. The fifth sub housing 15 is internally provided with a fourth mounting portion 152, and the circuit board 60 is mounted on the fourth mounting portion 152. The circuit board may be used to support the battery 50.

In at least one embodiment, the sixth sub housing 16 is further internally provided with at least one fifth mounting portion 162, and the fourth mounting portion 152 and the fifth mounting portion 162 are cooperated to mount the circuit board 60.

In at least one embodiment, the fifth sub housing 15 is internally provided with a sixth mounting portion 155, the sixth sub housing 16 is internally provided with a seventh mounting portion 165, and the sixth mounting portion 155 and the seventh mounting portion 165 are used to mount the vibrating motor 40. Specifically, the sixth mounting portion 155 is arranged at a free end of the fifth sub housing 15, and the seventh mounting portion 165 is arranged at a free end of the sixth sub housing 16.

In at least one embodiment, the fifth sub housing 15 further includes an eighth mounting portion 154, the sixth sub housing 16 further includes a ninth mounting portion 164, the eighth mounting portion 154 and the ninth mounting portion 164 are configured to mount the switch 70. The eighth mounting portion 154 defines at least one via hole 1541, the ninth mounting portion 164 defines at least one via hole 1641, and the via hole 1541 is communicated with the via hole 1641. The switch 70 includes at least one button 71, one end of the button 71 is passed through the via hole 1541 and the via hole 1641 and then connected with the circuit board 60, and the other end of the button 71 is extended out of the fifth sub housing 15 and the sixth sub housing 16, and in contact with the second housing 30. User can press a corresponding area of the second housing 30 to control the switch 70.

In at least one embodiment, the fifth sub housing 15 further includes a ninth mounting portion 157, the sixth sub housing 16 further includes a tenth mounting portion 167, the ninth mounting portion 157 and the tenth mounting portion 167 are configured to mount the charging element 80. The charging element 80 includes at least one charging pin 81, and the charging pin 81 is extended out of the ninth mounting portion 157 and the tenth mounting portion 167.

In at least one embodiment, the second housing 30 defines a first through hole 31 and at least one second through hole 32. The button 71 of the switch 70 is exposed from the first through hole 31. The charging pin 81 is exposed from the second through holes 32.

The above description is merely some embodiments. It should be noted that for one with ordinary skills in the art, improvements can be made without departing from the concept of the present disclosure, but these improvements shall fall into the protection scope of the present disclosure.

What is claimed is:

1. A massaging device configured for massaging erogenous zones of a human body, comprising:

a first housing; and a driving assembly, received in the first housing, the driving assembly comprises a driving element, an output shaft, a tilting shaft connected at an angle with the output shaft and a rotating element fixedly connected with a free end of the tilting shaft, a length of the tilting shaft has a range of about 10-50 millimeters, the output shaft is wholly received in the first housing, an extending direction of the output shaft is substantially parallel to a rotation axis of the driving element, an extending direction of the tilting shaft is not parallel to the rotation axis of the driving element, a length of the output shaft has a range of about 10-30 millimeters, the first housing defines a guiding cavity configured to receive and limit the rotating element, when the tilting shaft rotates, the rotating element is abutted against an inner wall of the guiding cavity to drive the first housing to swing by the rotating element, the rotating element is flexible;

wherein the first housing comprises a first sub housing and a second sub housing connected to the first sub housing to cooperatively receive the driving assembly;

the first sub housing comprises a first guiding element protruding from an inner wall of the first sub housing, the first guiding element defines a first via hole and is arranged with a first engaging portion protruding from an end of the first guiding element away from an inner wall of the first sub housing;

the second sub housing comprises a second guiding element protruding from an inner wall of the second sub housing, the second guiding element defines a second via hole;

when the first sub housing and the second sub housing are connected with each other, the second sub housing is engaged with the first engaging portion, the first guiding element and the second guiding element cooperatively define the guiding cavity to receive the rotating element, and the tilting shaft passes through the first via hole and the second via hole;

wherein the first housing further comprises:

a third sub housing;

a fourth sub housing, connected with the third sub housing, the third sub housing and the fourth sub housing are rotatably connected with the first sub housing and the second sub housing;

a fifth sub housing;

a sixth sub housing, connected with the fifth sub housing; and a flexible connecting member, configured to connect the fifth sub housing and the sixth sub housing with the third sub housing and the fourth sub housing;

and wherein the flexible connecting member comprises:

a first connecting portion, connected with the third sub housing and the fourth sub housing; a second connecting portion; and a third connecting portion, connected with the fifth sub housing and the sixth sub housing, the third connecting portion is connected with the first connecting portion by the second connecting portion;

wherein the first connecting portion sleeves a first end portion of the second connecting portion, the third connecting portion sleeves a second end portion of the second connecting portion opposite to the first end portion;

a space is defined between an end of the first connecting portion sleeving the first end portion of the second connecting portion and an end of the third connecting portion sleeving the second end portion of the second connecting portion;

an outer surface of a part of the second connecting portion is exposed from the space.

2. The massaging device according to claim 1, wherein the angle between the tilting shaft and an axis of the output shaft of the driving element has a range of about 0.5-25°.

3. The massaging device according to claim 1, wherein the output shaft of the driving element is integrated with the tilting shaft.

4. The massaging device according to claim 1, wherein the rotating element defines a receiving hole, and an end of the tilting shaft is received in the receiving hole.

5. The massaging device according to claim 1, wherein when the tilting shaft rotates, the rotating element is abutted against an inner wall of the guiding cavity to drive the first sub housing and the second sub housing to swing;

an outer wall of the first guiding element is provided with at least one first reinforcing rib, the first reinforcing rib is connected between the outer wall of the first guiding element and the inner wall of the first sub housing;

an outer wall of the second guiding element is provided with at least one second reinforcing rib, the second reinforcing rib is connected between the outer wall of the second guiding element and the inner wall of the second sub housing.

6. The massaging device according to claim 1, wherein the first housing comprises:

a first sub housing, comprising a first connecting element, and the first connecting element is protruded with a first connecting column;

a second sub housing, connected with the first sub housing and comprising a second connecting element, the tilting shaft and the rotating element are received in the first sub housing and the second sub housing, the second connecting element is protruded with a second connecting column;

a third sub housing, comprising a third connecting element, the third connecting element defines a first connecting hole; and a fourth sub housing, connected with the third sub housing and comprising a fourth connecting element, the fourth connecting element defines a second connecting hole, the first connecting column is rotatably received in the first connecting hole, and the second connecting column is rotatably received in the second connecting hole.

7. The massaging device according to claim 6, wherein an inner wall of the first connecting hole is protruded with a plurality of first protrusions, each two adjacent first protrusions defines a first receiving groove, and the first receiving groove is configured to receive lubricant.

8. The massaging device according to claim 7, wherein an inner wall of the second connecting hole is protruded with a plurality of second protrusions, each two adjacent second protrusions defines a second receiving groove, and the second receiving groove is configured to receive lubricant.

9. The massaging device according to claim 1, further comprising:

a first sub housing, protruded with a first connecting column;

a second sub housing, connected with the first sub housing and protruded with a second connecting column, the tilting shaft and the rotating element are received in the first sub housing and the second sub housing;

a third sub housing, defining a first connecting hole;

a fourth sub housing, connected with the third sub housing and defining a second connecting hole, the first connecting column is rotatably received in the first connecting hole, and the second connecting column is rotatably received in the second connecting hole; and two protecting sleeves, respectively sleeved on the first connection column and the second connection column, and respectively at least partially received in the first connecting hole and the second connecting hole.

10. The massaging device according to claim 1, further comprising:

a first sub housing, protruded with a first connecting column;

a second sub housing, connected with the first sub housing and protruded with a second connecting column, the tilting shaft and the rotating element are received in the first sub housing and the second sub housing;

a third sub housing, defining a first connecting hole;

a fourth sub housing, connected with the third sub housing and defining a second connecting hole, the first connecting column is rotatably received in the first connecting hole, and the second connecting column is rotatably received in the second connecting hole; and two shock-absorbing elements, respectively sleeved on the first connecting column and the second connecting column, and respectively at least partially received in the first connecting hole and the second connecting hole.

11. The massaging device according to claim 6, wherein the third connecting element defines a first notch, the fourth connecting element defines a second notch, and the tilting shaft is connected with the rotating element after passing through the first notch and the second notch.

12. The massaging device according to claim 1, further comprising:

a second housing, sleeved on the first housing, the second housing is made of a flexible material.

13. The massaging device according to claim 1, further comprising:

a battery, received in the first housing; and a circuit board, received in the first housing, the battery and the circuit board are electrically connected with the driving assembly.

14. The massaging device according to claim 13, wherein the massaging device further comprises a charging element electrically connected with the battery and the circuit board, the charging element comprises at least one charging pin extended out of the first housing.

15. The massaging device according to claim 1, wherein a size of the second connecting portion is smaller than a size of the first connecting portion and a size of the third connecting portion, so that the first connecting portion, the second connecting portion, and the third connecting portion cooperatively form an avoiding groove, the avoiding groove is defined around an outer periphery of the second connecting portion, the avoiding groove is configured to provide a space for a deformation or a rotation of the first connecting portion and the third connecting portion, so as to adjust an angle between the third sub housing and the fifth sub-housing and/or an angle between the fourth sub housing and the sixth sub-housing.

16. The massaging device according to claim 1, wherein a shape of the first connecting portion matches with that of a space enclosed by the third sub housing and the fourth sub housing; and/or a shape of the third connecting portion matches with that of a space enclosed by the fifth sub housing and the sixth sub housing.

17. The massaging device according to claim 1, wherein the first connecting portion defines a plurality of mounting holes, the third sub housing is protruded with at least one mounting post, and the fourth sub housing is protruded with at least one mounting post, the mounting post of the third sub housing and the mounting post of the fourth sub housing are mounted in the mounting holes of the first connecting portion to connect the flexible connecting member with the third sub housing and the fourth sub housing; and the third connecting portion defines a plurality of mounting holes, the fifth sub housing is protruded with at least one mounting post, and the sixth sub housing is protruded with at least one mounting post, the mounting post of the fifth sub housing and the mounting post of the sixth sub housing are mounted in the mounting holes of the third connecting portion to connect the flexible connecting member with the fifth sub housing and the sixth sub housing.

* * * * *